US005534375A

United States Patent [19]

Kaneko et al.

[11] Patent Number: 5,534,375

[45] Date of Patent: Jul. 9, 1996

[54] COMPOSITION FOR FORMING CHARGE TRANSPORT LAYER AND ELECTROPHOTOGRAPHIC MEMBER CONTAINING ALKOXYBENZENE

[75] Inventors: Susumu Kaneko; Kouji Ohkoshi; Keiichi Endo; Seiji Miyaoka; Megumi Matsui; Shigeru Hayashida; Takayuki Akimoto; Mikio Itagaki, all of Hitachi, Japan

[73] Assignee: Hitachi Chemical Co., Ltd., Tokyo, Japan

[21] Appl. No.: 361,670

[22] Filed: Dec. 22, 1994

[30] Foreign Application Priority Data

| | | | |
|---|---|---|---|
| Dec. 27, 1993 | [JP] | Japan | 5-329438 |
| Dec. 27, 1993 | [JP] | Japan | 5-331072 |
| Feb. 7, 1994 | [JP] | Japan | 6-013444 |

[51] Int. Cl.[6] ..... G03G 5/047

[52] U.S. Cl. ..... 430/58; 430/59; 252/501.1

[58] Field of Search ..... 430/56, 58, 59, 430/83; 252/501.1

[56] References Cited

U.S. PATENT DOCUMENTS

| | | | |
|---|---|---|---|
| 3,879,198 | 4/1975 | Saeva et al. | 430/72 X |
| 3,937,631 | 2/1976 | Eisenhut . | |
| 4,943,501 | 7/1990 | Kinoshita et al. | 430/58 |
| 4,971,877 | 11/1990 | Miyamoto et al. | 430/58 |
| 5,292,607 | 3/1994 | Aso et al. | 430/96 |
| 5,304,445 | 4/1994 | Itagaki et al. | 430/78 X |

OTHER PUBLICATIONS

Database WPI Section CH, Week 9246, Derwent Publications Ltd.

Patent Abstracts of Japan, vol. 13, No. 152 P–856, 13 Apr. 1989.

Patent Abstracts of Japan, vol. 13, No. 353 P–913, 8 Aug. 1989.

*Primary Examiner*—Roland Martin

*Attorney, Agent, or Firm*—Antonelli, Terry, Stout & Kraus

[57] ABSTRACT

A charge transport layer formed from a composition comprising a mixed solvent containing alkoxybenzene and a charge transport material, or a photoconductive layer formed from a composition comprising alkoxybenzene and an organic photoconductive material are effective for producing electrophotographic members excellent in image without damaging the circumstances as well as stable in maintaining good charging characteristics and dark decay characteristics after repeated use.

8 Claims, 2 Drawing Sheets

COMPOSITION FOR FORMING CHARGE TRANSPORT LAYER AND ELECTROPHOTOGRAPHIC MEMBER CONTAINING ALKOXYBENZENE

BACKGROUND OF THE INVENTION

The present invention relates to an electrophotographic member having high sensitivity and excellent dark decay characteristics and capable of maintaining surface potential and dark decay characteristics after repeated use, and a composition of coating solution for forming a photoconductive layer and a composition for forming a charge transport layer used in such an electrophotographic member.

The conventional electrophotographic members have been produced by vacuum depositing an approximately 50 μm thick selenium (Se) film on an electroconductive substrate such as aluminum. Such Se type electrophotographic members, however, have the problem that their sensitivity is limited to light with a wavelength of up to around 500 nm. An electrophotographic member is known in which an approximately 50 μm thick Se layer is formed on an electroconductive substrate and a selenium-tellurium (Se-Te) alloy layer is further formed thereon to a thickness of several μm. In this device, the spectral sensitivity can be elevated to a long wave-length region as the Te content in said Se-Te alloy is increased, but on the other hand, increase of the Te content deteriorates the surface potential retainability of the device, making it practically unusable for the intended purpose.

There is also known a laminate type electrophotographic member in which chlorocyan blue or a squarylium dyes derivative is coated to a thickness of about 1 μm on an aluminum substrate to form a charge generation layer, and a high-insulance mixture of polyvinyl carbazole or a pyrazoline derivative and a polycarbonate resin is further coated thereonto a thickness of 10–20 μm to form a charge transport layer. This electrophotographic member, however, has no sensitivity to light with a wavelength of 700 nm or above.

Many reports have been made recently on the improved versions of this laminate type electrophotographic members, that is, the laminated electrophotographic members having sensitivity at around 800 nm in the semiconductor laser oscillation region. In many of these laminated electrophotographic members, a phthalocyanine pigment is used as charge generating material, and on this charge generation layer of about 0.5–1 μm thickness, a high-insulance mixture of polyvinyl carbazole or a pyrazoline or hydrazone derivative and a polycabonate or polyester resin is coated to a thickness of 10–20 μm to form a charge transport layer.

A laminate type electrophotographic member has a wide scope of selection for the material used for forming the photosensitive layer, and a high-performance electrophotographic member can be provided by combining the best suited materials for the specific electrophotographic properties such as charging, dark decay, sensitivity, residual potential, repetition characteristics, plate life, etc., so that this type of electrophotographic member is now gaining ground in the art.

However, this laminate type electrophotographic member still involves some problems relating to static durability and repetition characteristics although mechanical durability is excellent. Especially the problem is pointed out that in repeated use of the member, the surface potential may sharply drop, causing a corresponding increase of dark decay, during the period from charging to development.

In order to improve such repetition characteristics or durability, it has been tried to incorporate various types of additives such as antioxidant in the composition. Such incorporation of additives could indeed provide certain improvements, but on the other hand it could cause a reduction of sensitivity or deterioration of other properties. Thus, in the prior art, it has been hardly possible to obtain a satisfactory electrophotographic member.

There have been proposed many electrophotographic members made of organic and inorganic materials, and among them, the function separated type member, in which the charge generation layer and the charge transport layer are separated from each other, has been offered to practical use as photosensitive member for copying machines and laser beam printers.

As the material of the charge transport layer, poly-N-vinylcarbazole compounds, pyrazoline derivatives, oxazole derivatives, oxadiazole derivatives, hydrazone derivatives, styryl derivatives and benzidine derivatives are well known.

The charge generation material and the charge transport material usually have per se no film forming properties; they are dispersed or dissolved in a solvent together with a binder resin, and the dispersion or solution is coated on an electroconductive substrate and dried to form a film.

The uniform film forming properties of the charge transport layer are an important subject in the electrophotographic process where long life of the elements is strongly required recently. Such uniform film forming properties of the charge transport layer are highly dependent on the layer composition, binder resin and solvent used therefor, so that proper selection of these materials is of much account. Generally, various types of polycarbonate resins are used as binder resin for the charge transport layer, while mixed solvents using a halogenated solvent are generally employed as solvent. Control of temperature and humidity is also important for forming a uniform charge transfer layer.

With a surge of the global movement for environmental protection of the earth in recent years, request is rising for total elimination of flon which destroys the ozone layer in the atmosphere and stronger regulation on use of halogen type solvents which may contaminate underground water, but there has yet been found no charge transfer layer composition which can meet these requirements.

SUMMARY OF THE INVENTION

An object of the present invention is to provide an electrophotographic member which can inhibit change of surface potential or dark decay in repeated use of the member and is capable of forming a stable image, and a composition for forming a photoconductive layer in said electrophotographic member.

Another object of the present invention is to provide a charge transport layer composition which can eliminate the prior art problems such as mentioned above, unnecessitates use of any halogen type solvent which is undesirable from the viewpoint of environmental protection, and is capable of forming a uniform charge transport layer, and an electrophotographic member using this composition.

The present invention provides a composition for forming a photoconductive layer comprising alkoxybenzene and an organic photoconductive material.

The present invention also provides a composition for forming a charge transport layer comprising a solvent containing alkoxybenzene and a charge transport substance.

The present invention further provides an electrophotographic member comprising an electroconductive substrate, and formed thereon an photoconductive layer containing 0.05 to 10% by weight of alkoxybenzene.

The present invention also provides an electrophotographic member comprising an electroconductive substrate, formed thereon a charge generation layer, and further formed thereon a charge transport layer, said charge transport layer being made of said composition for charge transport layer.

DESCRIPTION OF THE PREFERRED EMBODIMENTS

Figure 1:
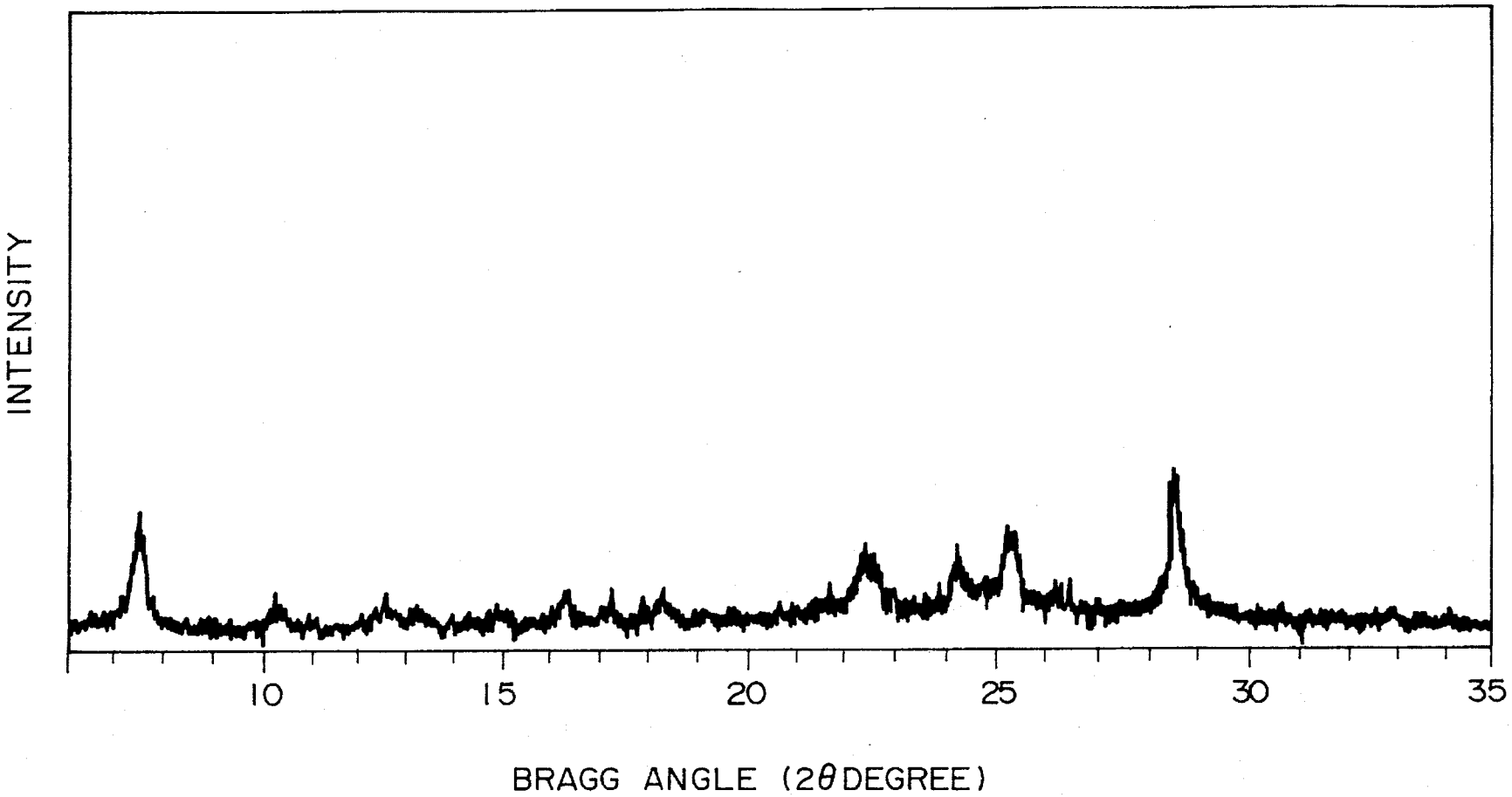
FIG. 1 is an X-ray diffraction pattern of the phthalocyanine prepared according to Preparation Example 1.

A salient feature of the present invention resides in an electrophotographic member characterized in that alkoxybenzene is contained in an amount of 0.05–10% by weight in a photoconductive layer provided on an electroconductive substrate, and a composition for forming said photoconductive layer containing alkoxybenzene.

The alkoxybenzene usable in this invention may include the alkoxybenzene having 7 to 10 carbon atoms. Among the alkoxybenzene, anisole and ethoxybenzene are preferred, and anisole is more preferred. The above alkoxybenzene may be used singly or as a mixture thereof.

It is desirable that the alkoxybenzene content in the photoconductive layer (a charge transport layer in case the photoconductive layer is a laminated film comprising a charge generation layer and a charge transport layer) is 0.05 to 10% by weight based on the photoconductive layer. This is for the reason that when said content is less than 0.05% by weight, no satisfactory effect of being improved repetition characteristics drastically is provided, and when said content exceeds 10% by weight, charging is reduced and residual potential is increased.

Various methods are available for containing alkoxybenzene in the photoconductive layer. For example, a coating solution containing alkoxybenzene is used for forming a photoconductive layer (a charge transport layer in case the photoconductive layer is a laminated film comprising a charge generation layer and a charge transport layer), and the coat is dried by properly adjusting the drying conditions so that an appropriate amount of alkoxybenzene will be left in the formed photoconductive layer (or charge transport layer). In another method, a coating solution not containing alkoxybenzene is used for forming a photoconductive layer, and after a photoconductive layer has been formed, an appropriate amount of alkoxybenzene is contained in the formed photoconductive layer by a proper method such as spray or steam bath. According to still another method, alkoxybenzene which has been used when forming a photoconductive layer is once dried away, and then an appropriate amount of alkoxybenzene is contained in the photoconductive layer.

In case an appropriate amount of alkoxybenzene is left in the photoconductive layer by adjusting the drying conditions, the drying temperature is adjusted to be preferably 70°–160° C., more preferably 80°–130° C., so that a desired amount of alkoxybenzene will be contained in the photoconductive layer.

The content (retention) of alkoxybenzene in the photoconductive layer can be determined by measuring the weight loss of the layer by thermal analysis. For example, 10 mg of the photoconductive layer is weighed out and immediately heated from room temperature to 185° C. while flowing nitrogen gas at a rate of 200 ml/min, and after retaining said layer at said temperature for 10 minutes, the weight loss of the layer is measured. The content of alkoxybenzene in the photoconductive layer can be determined from the measured loss in weight of the layer.

It is also possible to determine the content of alkoxybenzene by means of gas chromatography. For example, 30 mg of the photoconductive layer is weighed out and immersed in a solvent such as acetone, methyl ethyl ketone, tetrahydrofuran, ethanol or the like. Then a residual solvent is extracted by applying supersonic wave or other means, and the content of alkoxybenzene is determined according to the internal standard method using gas chromatography by adding toluene, benzene, hexane or the like as internal standard material.

The electrophotographic member of the present invention is characterized by the photoconductive layer provided on an electroconductive substrate.

The photoconductive layer is a layer containing an organic photoconductive material. This layer may be embodied as a film of an organic photoconductive material, a film containing an organic photoconductive material and a binder, or a laminated film comprising a charge generation layer and a charge transport layer.

As said organic photoconductive material, there can be used, for example, the phthalocyanine compositions such as mentioned below and/or other known compositions (e.g. organic pigments capable of generating electric charges mentioned below). It is preferable to use a combination of a phthalocyanine composition a charge transport material and if necessary, an organic pigment capable of generating electric charges, for forming a film of an organic photoconductive material.

A phthalocyanine composition such as mentioned below and/or an organic pigment capable of generating electric charges are preferably used for forming said charge generation layer. For forming the charge transport layer, usually a material capable of transporting electric charges is used.

The phthalocyanine compositions known in the art can be used in the present invention. Among such compositions, a mixed crystal of titanyl phthalocyanine and indium phthalocyanine chloride and a mixed crystal of titanyl phthalocyanine and a chlorinated derivative of indium phthalocyanine chloride are preferred because of high sensitivity. These phthalocyanine compositions can be produced, for example, according to the following process.

18.4 g (0.144 mole) of phthalonitrile is added to 120 ml of α-chloronaphthalene, followed by dropwise addition of 4 ml (0.0364 mole) of titanium tetrachloride under a nitrogen atmosphere. Thereafter, the mixture is stirred under heating to carry out the reaction at 200°–220° C. for 3 hours. The reaction mixture is hot filtered at 100°–130° C. and washed with α-chloronaphthalene and then with methanol. The resulting solution is hydrolyzed (at 90° C. for one hour) with 140 ml of ion exchange water. This operation is repeated until the solution is neutralized, and then the solution is washed with methanol. Thereafter, the solution is washed sufficiently with N-methyl-2-pyrrolidone (NMP) at 100° C., followed by additional methanol washing. The thus obtained compound is dried in vacuo under heating at 60° C. to give the objective titanyl phthalocyanine (yield: 46%).

The methods for the synthesis of indium phthalocyanine chloride or a chlorinated derivative thereof are shown in Inorganic Chemistry 19, 3131 (1980), JP-A-59-44054, etc.

Indium phthalocyanine chloride can be produced, for example, according to the following process.

78.2 mmole of phthalonitrile and 15.8 mmole of indium trichloride are distilled twice, put into 100 ml of deoxidizedquinoline, refluxed under heating for 0.5–3 hours, allowed to cool gradually and filtered after cooled to 0° C., and the formed crystals are washed with methanol, toluene and acetone successively and dried at 110° C.

A chlorinated derivative of indium phthalocyanine chloride can be produced, for example, in the following way. A mixture of 156 mmole of phthalonitrile and 37.5 mmole of indium trichloride is melted at 300° C. and kept heated at this temperature for 0.5–3 hours, and the resulting crude product of indium chlorophthalocyanine monochloride is washed with α-chloronaphthalene by using a Soxhlet's extractor.

In the phthalocyanine composition comprising a mixed crystal of titanyl phthalocyanine and indium phthalocyanine chloride or a mixed crystal of titanyl phthalocyanine and a chlorinated derivative of indium phthalocyanine chloride, it is preferable in view of electrophotographic properties such as electrical charging characteristics, dark decay, sensitivity, etc., that the content of titanyl phthalocyanine be in the range of 20–95% by weight, more preferably 50–90% by weight, even more preferably 65–90% by weight, most preferably 75–90% by weight.

A mixed crystal of titanyl phthalocyanine and indium phthalocyanine chloride or a mixed crystal of titanyl phthalocyanine and a chlorinated derivative of indium phthalocyanine chloride can be produced from simple mixing of two phthalocyanine compounds by an acid pasting treatment and a solvent treatment as described below.

For example, 1 g of a mixture of two phthalocyanine compounds is dissolved in 50 ml of concentrated sulfuric acid, and the solution is stirred at room temperature and added dropwise into 1 liter of ion exchange water, which has been cooled with icy water, over a period of about one hour, preferably 40–50 minutes, to cause reprecipitation. The solution is allowed to stand overnight, then the supernatant is removed by decantation and the precipitate is recovered by centrifuging. The precipitate is washed repeatedly with ion exchange water (wash liquor) until the washings come to have a pH of 2–5 and a conductivity of 5–500 $\mu S/cm^2$, then washed sufficiently with methanol and dried in vacuo under heating at 60° C. to give a powder.

When the pH of the washings exceeds 5, the objective mixed crystal can not be obtained even if a solvent treatment such as described below is carried out. On the other hand, when said pH is less than 2, the electrophotographic member produced by using the obtained mixed crystal proves poor in electrophtographic properties.

The thus obtained powder is treated with an organic solvent to cause crystal conversion, thereby producing a high-sensitivity phthalocyanine composition.

For example, 1 g of the powder obtained in the manner described above is put into 10 ml of N-methyl-2-pyrrolidone, toluene or xylene used as organic solvent, and the mixture is stirred under heating (powder/solvent=1/1 to 1/100 by weight). Heating temperature is 50°–200° C., preferably 80°–150° C., and heating time is 1–10 hours, preferably 1–6 hours. Thereafter, the mixture is filtered, washed with methanol and dried in vacuo under heating at 60° C. to give 700 mg of crystals of the objective phthalocyanine composition. The organic solvents usable in the above process include alcohols such as methanol, ethanol, isopropanol and butanol, alicyclic hydrocarbons such as n-hexane, octane and cyclohexane, aromatic hydrocarbons such as benzene, toluene and xylene, ethers such as tetrahydrofuran, dioxane, diethyl ether, ethylene glycol dimethyl ether and ethylene glycol diethyl ether, ketones such as acetate cellosolve, acetone, methyl ethyl ketone, cyclohexanone and isophorone, esters such as methyl acetate and ethyl acetate, non-chlorine type organic solvents such as dimethyl sulfoxide, dimethylformamide, phenol, cresol, anisol, nitrobenzene, acetophenone, benzyl alcohol, pyridine, N-methyl-2-pyrrolidone, quinoline and picoline, and chlorine type organic solvents such as dichloromethane, dichloroethane, trichloroethane, tetrachloroethane, carbon tetrachloride, chloroform, chloromethyloxirane, chlorobenzene and dichlorobenzene. Of these solvents, ketones, alcohols and non-chlorine type organic solvents are preferred, and specifically N-methyl-2-pyrrolidone, pyridine, isopropanol, methyl ethyl ketone and diethyl ketone are recommended.

The organic pigments capable of generating electric charges and usable in this invention include azoxibenzene pigments, disazo pigments, trisazo pigments, benzimidazole pigments, polycyclic quinone dyes, indigoid dyes, quinacridone dyes, perillene dyes, methine dyes, and metallic or nonmetallic phthalocyanine dyes having various crystal structures such as α type, β type, γ type, δ type, ε type and χ type. These dyes are disclosed in, for example, JP-A-47-37543, JP-A-47-37544, JP-A-47-18543, JP-A-47-18544, JP-A-48-43942, JP-A-48-70538, JP-A-49-1231, JP-A-49-105536, JP-A-50-75214, JP-A-53-44028, and JP-A-54-17732.

It is also possible to use τ type, τ' type, η type and η' type nonmetallic phthalocyanines such as disclosed in JP-A-58-182640 and European Patent Laid-Open No. 92,255, and the organic pigments which generate a charged carrier on irradiation with light.

Further, it is also possible to use quinoline dyes, naphthalocyanine dyes and pyrrolopyrrole dyes as organic pigments capable of generating electric charges.

These pigments (dyes) may be used either singly or in combination.

The charge transport materials usable in this invention include the high-molecular weight compounds such as poly-N-vinylcarbazole, halogenated poly-N-vinylcarbazole, polyvinylpyrene, polyvinylindolo-quinoxaline, polyvinylbenzothiophene, polyvinylanthracene, polyvinylacridine and polyvinylpyrazoline, and low-molecular weight compounds such as fluorenone, fluorene, 2,7-dinitro-9-fluorenone, 4H-indeno(1,2,6)-thiophene-4-one, 3,7-dinitrodibenzothiophene-5-oxide, 1-bromopyrene, 2-phenylpyrene, carbazole, N-ethylcarbazole, 3-phenylcarbazole, 3-(N-methyl-N-phenylhydrazone)methyl- 9-ethylcarbazole, 2-phenylindole, 2-phenylnaphthalene, oxadiazole, 2,5-bis(4- diethylaminophenyl)- 1,3,4-oxadiazole, 1-phenyl-3-(4-diethylaminostyryl)-5-(4-diethylaminostyryl)-5-(4-diethyllaminophenyl)pyrazoline, 1-phenyl-3-(p-diethylaminophenyl)pyrazoline, p-(dimethylamino)-stilbene, 2-(4-dipropylaminophenyl)- 4-(4-dimethylaminophenyl)-5-(2-chlorophenyl)- 1,3-oxazole, 2-(4-dimethylaminophenyl)-4-(4-dimethylaminophenyl)-5-(2-fluorophenyl)-1,3-oxazole, 2-(4-diethylaminophenyl)-

4-(4-dimethylaminophenyll)-5-(2-fluorophenyl)-1,3-oxazole, 2-(4-dipropylaminophenyl)-4-(4-dimethylaminophenyl)-5-(2-fluorophenyl)-1,3-oxazole, imidazole, chrysene, tetraphene, acridene, triphenylamine, benzidine, oxazole, oxatriazole, hydrazones, styryl compounds, 1-phenyl-3-(4-diethylaminostyryl)- 5-(4-diethylaminophenyl)pyrazoline, 2-phenyl- 4-(4-diethylaminophenyl)-5-phenyloxazole, 1,1-bis(p-diethylaminophenyl)- 4,4-diphenyl-1,3-butadiene, and derivatives thereof. The benzidine derivatives represented by the following formula (I) are especially preferred for use as charge transport material in the present invention:

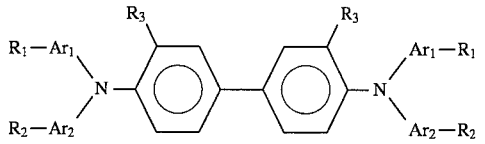

(I)

wherein $R_1$ and $R_2$ represent independently hydrogen atom, halogen atom, alkyl group, alkoxyl group, aryl group (e.g. nonsubstituted aryl groups such as phenyl, naphthyl, anthracene,phenanthrene, tetralin, azulene, biphenyl, acenaphthylene, acenaphthene, fluorene, triphenylene, pyrene, chrysene, naphthalene, picene, perillene, benzopyrene, rubicene, coronene, tolyl, terphenyl, and ovalene), fluoroalkyl group or fluoroalkoxyl group, but at least one of $R_1$ and $R_2$ is fluoroalkyl group or fluoroalkoxyl group; $R_3$'s represent independently hydrogen atom or alkyl group; and $Ar_1$ and $Ar_2$ represent independently aryl group (such as mentioned above).

With reference to the formula (I), examples of alkyl group are methyl, ethyl, n-propyl, iso-propyl, n-butyl and tert-butyl. Examples of alkoxyl group are methoxy, ethoxy, n-propoxy and iso-propoxy. Examples of fluoroalkyl group are trifluoromethyl, trifluoroethyl and heptafluoropropyl. Examples of fluoroalkoxyl group are trifluoromethoxy, 2,3-difluoroethoxy, 2,2,2-trifluoroethoxy, 1H,1H-pentafluoropropoxy, hexafluoroiso-propoxy, 1H,1H-pentafluorobutoxy, 2,2,3,4,4-hexafluorobutoxy and 4,4,4-trifluorobutoxy. Examples of the benzidine derivatives represented by the formula (I) include the following compounds No. 1 to No. 6:

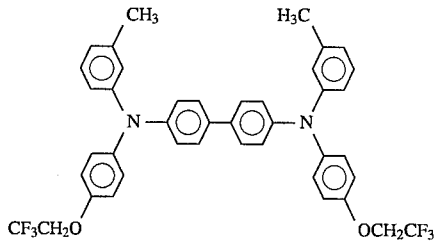

No. 1

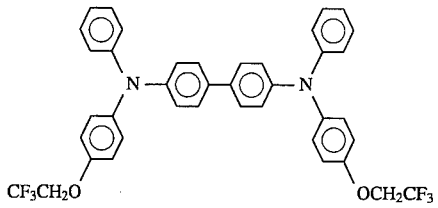

No. 2

-continued

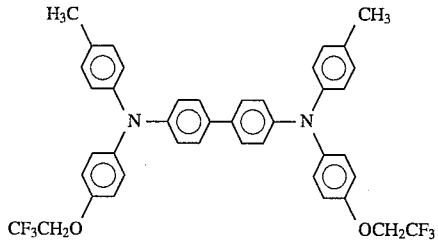

No. 3

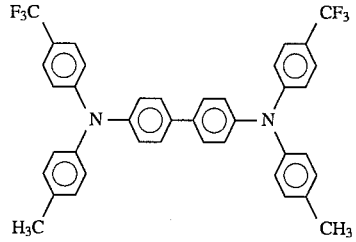

No. 4

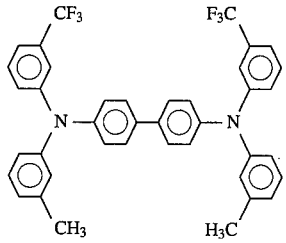

No. 5

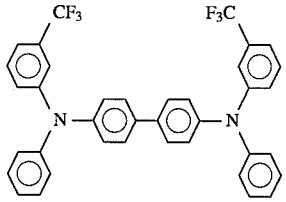

No. 6

These charge transport materials may be used either singly or in combination.

In case a phthalocyanine composition such as mentioned above and, if necessary, an organic pigment generating electric charges (these two being referred to as the former) are used in combination with a charge transport material (referred to as the latter), they are preferably blended such that the latter to former weight ratio will be 10 to 1–2 to 1. In this case, it is desirable to use a binder in an amount within the range of 0–500% by weight, preferably 30–500% by weight,based on the total amount of the compounds (former+latter). In case a binder is used, it is possible to further add, as desired, the adjuncts such as plasticizer, fluidity imparting agent, pinhole inhibitor, etc.

In case of forming a laminate type photoconductive layer comprising a charge generation layer and a charge transport layer, a phthalocyanine composition such as mentioned above and, if necessary, an organic pigment capable of generating electric charges are contained in the charge generation layer. A binder may be contained therein in an amount not exceeding 500% by weight based on the total amount of the phthalocyanine composition and the organic pigment. It is also possible to add one or more of said adjuncts in an amount not exceeding 5% by weight based on the total amount of the phthalocyanine composition and the organic pigment. In the charge transport layer, a charge transport material such as mentioned above is contained, and further a binder may be contained in an amount not exceeding 500% by weight based on the charge transport material. In case the charge transport material is a low-molecular weight compound, it is desirable to contain a binder in an amount not less than 50% by weight based on the low-molecular weight compound.

The binders usable in any of the above-described cases in the present invention include silicone resin, polybutyral resin, polyamide resin, polyurethane resin, polyester resin, epoxy resin, polyketone resin, polycarbonate resin, polyacrylic resin, polystyrene resin, styrene-butadienecopolymer, methyl polymethacrylate resin, polyvinyl chloride, ethylene-vinyl acetate copolymer, vinyl chloride-vinyl acetate copolymer, polyacrylamide resin, polyvinylcarbazole, polyvinylpyrazoline, polyarylate resin, polyetherimido resin, polyether-sulfone resin, polybutadiene resin, polyisoprene resin, melamine resin, benzoguanamine resin, polychloroprene resin, polyacrylonitrile resin, ethyl cellulose resin, nitrocellulose resin, urea resin, phenol resin, phenoxy resin, polyvinyl butyral resin, formal resin, vinyl acetate resin, polyester carbonate resin and polyvinylpyrene. Thermosetting or photosetting resins which are crosslinked by heat or light can also be used.

It may be thus possible to use all types of resins which are insulating and capable of forming a film in the ordinary state and/or curable by heat or light to form a film for binders. These binders may be used either singly or in combination.

Examples of the plasticizers usable in this invention include halogenated paraffin, dimethylnaphthaline and dibutyl phthalate. Examples of the fluidity imparting agents are Modaflow (Monsanto Chemical Co., Ltd.) and Acronal (BASF AG). Examples of the hinhole inhibitors are benzoin and dimethyl phthalate. These adjuncts are properly selected and used to suit the situation, with the amounts thereof added being also appropriately decided according to circumstances.

The electroconductive substrate used in this invention may be a metal plate made of aluminum, iron, copper, nickel or the like, a paper plastic film, sheet or seamless belt which has been subjected to an electroconductive treatment, a plastic film, sheet or seamless belt laminated with a foil of metal such as aluminum, a metal-made film, sheet or seamless belt, a metal drum or the like.

In the electrophotographic member having a photoconductive layer provided on an electroconductive substrate, the thickness of the photoconductive layer is preferably 5 to 50 μm. In the case of a laminate type photoconductive layer comprising a charge generation layer and a charge transport layer, the charge generation layer is preferably so formed as to have a thickness of 0.001 to 10 μm, more preferably 0.2 to 5 μm. When its thickness is less than 0.001 μm, it is difficult to form the charge generation layer with uniform thickness. When the thickness exceeds 10 μm, the electrophotographic properties of the produced electrophotographic member tends to deteriorate. The thickness of the charge transport layer is preferably 5 to 50 μm, more preferably 8 to 25 μm. When its thickness is less than 5 μm, the initial potential lowers, and when the thickness exceeds 50 μm, the sensitivity of the produced electrophotographic member tends to reduce.

For forming a photoconductive layer on an electroconductive substrate, methods are available in which an organic photoconductive material is deposited on an electroconductive substrate, or an organic photoconductive material and, if necessary, other substance(s) such as an organic pigment generating electric charges, a charge transport material, and a binder are uniformly dissolved or dispersed in solvent and the solution or dispersion is coated on an electroconductive substrate and dried.

In case the solution or dispersion containing an organic photoconductive material, a solvent, and if necessary, other substance(s) is used, a mixed solvent including alkoxybenzene and the solvent other than alkoxybenzene can be used.

As the solvent other than alkoxybenzene used for the mixed solvent for forming the photoconductive layer, the solvent other than alkoxybenzene used for the mixed solvent for forming the charge transport layer, which is mentioned below, can be used.

The ratio of alkoxybenzene to other solvent is preferably 60 to 40–5 to 95 by weight, more preferably, 20 to 80–5 to 95 by weight.

The amount of the above mixed solvent for forming the photoconductive layer is preferably so selected that the solids (nonvolatiles) in the composition for forming the photoconductive layer will hold 5 to 30% by weight, more preferably 15 to 25% by weight, eve more preferably 18 to 23% by weight of the composition.

Various methods are employable for coating, such as spin coating, dipping, etc. The same techniques are applicable when forming a charge generation layer and a charge transport layer. In this case, either of the two layers may be placed on the upper side, or a charge generation layer may be sandwiched between two charge transport layers.

When a phthalocyanine composition is spin coated, it is preferable that a coating solution prepared by dispersing a phthalocyanine composition in a halogenated solvent or a protic solvent such as chloroform or tolubene be spin coated at a speed of 500 to 4,000 r.p.m. In the case of dip coating, preferably a coating solution is prepared by dispersing a phthalocyanine composition in the above mixed solvent for forming the photoconductive layer by applying a ball mill, supersonic waves or other means,.and an electroconductive substrate is dipped in this coating solution.

The electrophotographic member of the present invention may have a thin adhesive layer or barrier layer immediately above the substrate. It may also have a protective layer at the surface.

The thickness of these layers is 0.01–20 μm, respectively.

In order to form the adhesive layer, barrier layer, or protective layer, a solution or dispersion containing a resin such as polyamide, polyimide, polyester or polycarbonate, etc. is used and an organic solvent is coated by dip coating, spray coating, roll coating, etc., dried and cured.

Now the compositions for charge transport layer comprising a charge transport material and a solvent containing alkoxybenzene, and an electrophotographic member produced by using such composition are described.

The alkoxybenzene usable in this invention may include the alkoxybenzene having 7 to 10 carbon atoms. Among the alkoxybenzene, anisole and ethoxybenzene are preferred, and anisole is more preferred.

The anisole and ethoxybenzene used in the present invention are those having the following chemical structures (II) and (III), respectively:

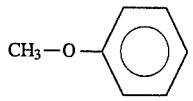

(II)

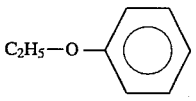

(III)

Both of them are commercially available from Wako Pure Chemical Industries Co., Ltd.

The above alkoxybenzene may be used either singly or in combination.

The solvent containing alkoxybenzene may be a mixture of alkoxybenzene and the solvent other than alkoxybenzene.

The solvents other than alkoxybenzene used in the present invention are not subject to any specific restrictions; it may be possible to use any of the conventional solvents employed for the similar purposes, but it is recommended to use a non-halogen type solvent for reasons of environmentalhygiene. Use of a ketone type solvent such as methyl ethyl ketone or an ether type solvent such as tetrahydrofuran is preferred in view of uniform solubility of the composition for charge transport layer and uniformity of the coating film formed by dip coating. Of these solvents, those having a boiling point of 35°–100° C., especially 35°–90° C., are preferred.

Typical examples of these solvents other than alkoxybenzene are acetone, methyl ethyl ketone, methyl isobutyl ketone, tetrahydrofuran, ethyl acetate, toluene, xylene, cellosolve, methanol, isopropyl alcohol, isobutyl alcohol, n-butyl alcohol, dioxane, dimethylformamide, chloroform, dichloromethane, 1,2-dichloroethane, cyclohexanone and cyclohexane. These solvents may be used either singly or in combination.

In the composition of the present invention, the ratio of alkoxybenzene to other solvent is preferably 60 to 40–5 to 95 (by weight), more preferably 20 to 80–5 to 95 (by weight). A too high ratio of alkoxybenzene may cause sags and runs of the coating solution when it is applied for forming the charge transport layer, while a too low ratio of said solvent tends to cause clouding or nonuniformity of the formed charge transport layer.

Clouding of the charge transport layer depends on the content of alkoxybenzene in said layer, that is, the phenonemon of clouding is greatly improved by containing a specific amount of alkoxybenzene in the charge transport layer. It is desirable that the alkoxybenzene content in the charge transport layer is 0.05 to 10% by weight based on said layer. This is for the reason that when said content is less than 0.05% by weight, no satisfactory clouding preventive effect is provided, and when said content exceeds 10% by weight, the charge transport layer tends to become nonuniform. The most preferred range of alkoxybenzene content in the charge transport layer is 0.1 to 8% by weight based on said layer.

Several methods are available for containing a proper amount of alkoxybenzene in the charge transport layer. For example, alkoxybenzene is used as solvent when forming the charge transport layer, and the layer is dried by adjusting the drying conditions so that an appropriate amount of alkoxybenzene will be left in the layer, or the charge transport layer is formed without using alkoxybenzene, and after formation of the layer, a desired amount of alkoxybenzene is contained in the layer by a suitable method such as spray or steam bath. In another method, alkoxybenzene used when forming the charge transport layer is removed by drying, and then an appropriate amount of alkoxybenzene is contained in the charge transport layer.

In case an appropriate amount of alkoxybenzene is left in the charge transport layer by adjusting the drying conditions, the drying temperature is adjusted to be preferably 70° to 160° C., more preferably 80° to 130° C., so that a desired amount of alkoxybenzene will be contained in the charge transport layer.

The residual amount of alkoxybenzene in the charge transport layer can be determined by measuring the loss in weight of the layer by thermal analysis. Specifically, 10 mg of the charge transport layer is weighed out, immediately heated from room temperature to 185° C. while flowing nitrogen gas at a rate of 200 ml/min and maintained at 185° C. for 10 minutes, and then the loss in weight of the charge transport layer is measured. The loss in weight can be determined as the residual amount of alkoxybenzene.

It is also possible to determine residual alkoxybenzene in the charge transport layer by gas chromatography. Specifically, 30 mg of the charge transport layer is weighed out and immersed in a solvent such as acetone, methyl ethyl ketone, tetrahydrofuran, ethanol or the like, and then a solvent is extracted by using supersonic waves or other means. Thereafter, toluene, benzene, hexane or like solvent is added as internal standard material, and the residual alkoxybenzene is determined by gas chromatography according to internal standard method.

The amounts of alkoxybenzene and other solvent to be used are preferably so selected that the solids (nonvolatiles) in the charge transport layer composition will hold 5 to 30% by weight, more preferably 15 to 25% by weight, even more preferably 18 to 23% by weight of the composition.

As the charge transport material for forming the charge transport layer, there can be used the materials for forming the photoconductive layer mentioned before. Among them, the benzidine derivatives mentioned before are especially preferred.

The charge transport layer of the present invention may contain, if necessary, a known binder.

As the binder for the charge transport layer, those for the photoconductive layer mentioned before can be used.

The amount of the binder used is preferably not more than 450 parts by weight to 100 parts by weight of the charge transport material so that the binder will not affect the electrophotographic properties of the product. In case of using a low-molecular weight charge transport material, the amount of the binder is preferably not less than 50 parts by weight for the reason of maintaining film properties.

The charge transport layer composition of the present invention may contain known additives such as plasticizer, fluidity imparting agent, pinhole inhibitor, antioxidant, etc. These additives may be used in various proportions, but the amount of these additives used is preferably not more than 15 parts by weight to 100 parts by weight of the charge transport material.

The charge transport layer can be formed by uniformly dissolving a charge transport material and, if necessary, a binder and additive(s) in a solvent such as mentioned above to prepare a coating solution, coating this solution on the charge generation layer by a suitable method such as dip coating, spray coating, roll coating, applicator coating, wire bar coating, etc., and drying the coat.

The present invention is also intended to provide an electrophotographic member having a charge transport layer formed by using a composition for said layer prepared in the manner described above.

The electrophotographic member of this invention is obtained by forming a charge generation layer and a charge transport layer on an electroconductive substrate after providing, as desired, an undercoat on said substrate.

As the electroconductive substrate used for preparing an electrophotographic member of the present invention, there can be used the electroconductive substrate mentioned before.

A known type of undercoat layer may be provided on the electroconductive substrate. Such undercoat layer may be formed with fine particles of a pertinent compound or compounds such as titanium oxide, aluminum oxide, zirconia, titanic acid, zirconic acid, lanthanum lead, titanium black, silica,lead titanate, barium titanate or the like, or a resin or resins such as polyamide resin, phenol resin, casein, melamine resin, benzoguanamine resin, polyurethane resin, epoxy resin, cellulose, polyvinyl butyral resin, etc. These particulate compounds and resins may be used either singly or in combination. It is recommended to use both fine particles and resin since, in this case, the resin is adsorbed on the fine particles to give a smooth coating film.

An undercoat layer can be formed by first preparing a coating solution by dispersing or dissolving the fine particles of said compound(s) and/or said resin(s) in a solvent,coating this solution on an electroconductive substrate by a suitable method such as dip coating, spray coating, roll coating, applicator coating, wire bar coating, etc., and drying the coat.

The solvents usable in forming said coating solution include acetone, methyl ethyl ketone, methyl isobutyl ketone, tetrahydrofuran, ethyl acetate, toluene, xylene, cellosolve,methanol, isopropyl alcohol, isobutyl alcohol, n-butyl alcohol and the like. These solvents may be used either singly or in combination. The thickness of the undercoat is usually 0.01 to 20 μm, preferably 0.1 to 3 μm. When this thickness is less than 0.01 μm, it is hard to form a uniform undercoat, and when the thickness exceeds 20 μm, the electrophotographic properties of the product tend to deteriorate.

After an undercoat layer has been formed in the manner described above, a charge generation layer may be formed on this undercoat layer by coating thereon a charge generating material by a suitable coating method such as dipping, spraying, roll coating, applicator coating, wire bar coating, etc., and drying the coat.

The material used for the charge generation layer may not be specified in this invention; there can be used the organic pigments of generating electric charges mentioned before.

The charge generation layer may contain, if necessary, a known binder. These can be used the binders mentioned before.

The amount of the binder resin used is preferably in the range of 5 to 200 parts by weight to 100 parts by weight of the charge generating material so that the presence of binder resin will not adversely affect the electrophotographic properties of the product. The charge generation layer may contain an additive or additives same as used in the charge transport layer, such as plasticizer, fluidity imparting agent, pinhole inhibitor, etc. The amount of such additives contained is preferably not more than 5 parts by weight based on 100 parts by weight of the charge generating material.

As a solvent used for forming the charge generation layer by coating, the solvents other than alkoxybenzene, which are mentioned before, can be used. These solvents can be used either singly or in combination. The solvent for forming the charge generation layer may be used in various proportion, but the amount of the solvent is preferably so selected that the solids (nonvolatiles) in the composition for forming the charge generation layer will hold 2 to 30% by weight, more preferably 15 to 25% by weight, even more preferably 18 to 23% by weight of the composition.

The thickness of the charge generation layer is usually 0.01 to 2 μm, preferably 0.1 to 0.8 μm. When its thickness is less than 0.01 μm, it is difficult to form the charge generation layer uniformly, and when the thickness exceeds 2 μm, the electrophotographic properties of the product tend to deteriorate.

On the charge generation layer formed in the manner described above, a composition for charge transport layer prepared in the manner described above is coated to form a charge transport layer by a method such as described above.

The thickness of the charge transport layer is usually 5 to 50 μm, preferably 8 to 30 μm. When its thickness is less than 5 μm, the initial potential lowers, and when the thickness exceeds 50 μm, the electrophotographic properties of the product tend to deteriorate.

In the electrophotographic member of the present invention, a protective layer may be formed on the photosensitive layer comprising said charge generation layer and charge transport layer. The thickness of the protective layer is 0.01 to 10 μm, preferably 0.1 to 3 μm. When its thickness is less than 0.01 μm, the effect of the protective layer is small, reducing durability of the member, and when the thickness exceeds 10 μm, the sensitivity of the product tends to lower, causing an increase of residual potential.

For carrying out printing by using the electrophotographic member of the present invention, said member is subjected to electric charging and exposure to light, followed by development, and the image is transferred onto a plain paper and fixed, all in the usual ways.

The present invention is further illustrated with reference to the examples thereof. In the following Examples, all "percents (%)" are by weight unless otherwise noted.

Preparation Example 1

1 g of a phthalocyanine mixture consisting of 0.75 g of titanyl phthalocyanine and 0.25 g of indium phthalocyanine was dissolved in 50 ml of sulfuric acid and stirred at room temperature for 30 minutes. The resulting solution was added dropwise, over a period of about 40 minutes, into 1 liter of ion exchange water cooled with icy water, and reprecipitated. The solution was further stirred under cooling for one hour and then allowed to stand overnight. After removing the supernatant liquid by decantation, the precipitate was separated by centrifugation to give 700 mg of precipitate. 120 ml of ion exchange water was added as washing water to 700 mg of precipitate for the first run of washing, and then the precipitate and washing water were separated by centrifugation. The similar washing operation was repeated five times successively. The pH and conductivity of the washing liquor (washings) separated after the 6th run of washing operation were measured (at 23° C.). A pH meter Model PH51 mfd. by Yokokawa Electric Co., Ltd. was used for measuring pH. Conductivity was measured by a conductivity measuring device Model SC-17A mfd. by Shibata Scientific Machinery Co., Ltd. The pH of the washings was 3.3 and the conductivity was 65.1 μS/cm. Then the precipitate was washed thrice with 60 ml of methanol and dried in vacuo under heating at 60° C. for 4 hours.

1 g of the resulting dried product was put into 10 ml of isopropyl alcohol, and the solution was stirred under heating at 90° C. for 8 hours, then filtered, washed with methanol and dried in vacuo under heating at 60° C. for 4 hours to obtain the phthalocyanine crystals having main diffraction peaks at the Bragg angles (2°θ±0.2°) of 7.5°, 22.5°, 24.3°, 25.3° and 28.6°. A X-ray diffraction spectrum of the obtained crystals is shown in FIG. 1.

Preparation Example 2

Figure 2:
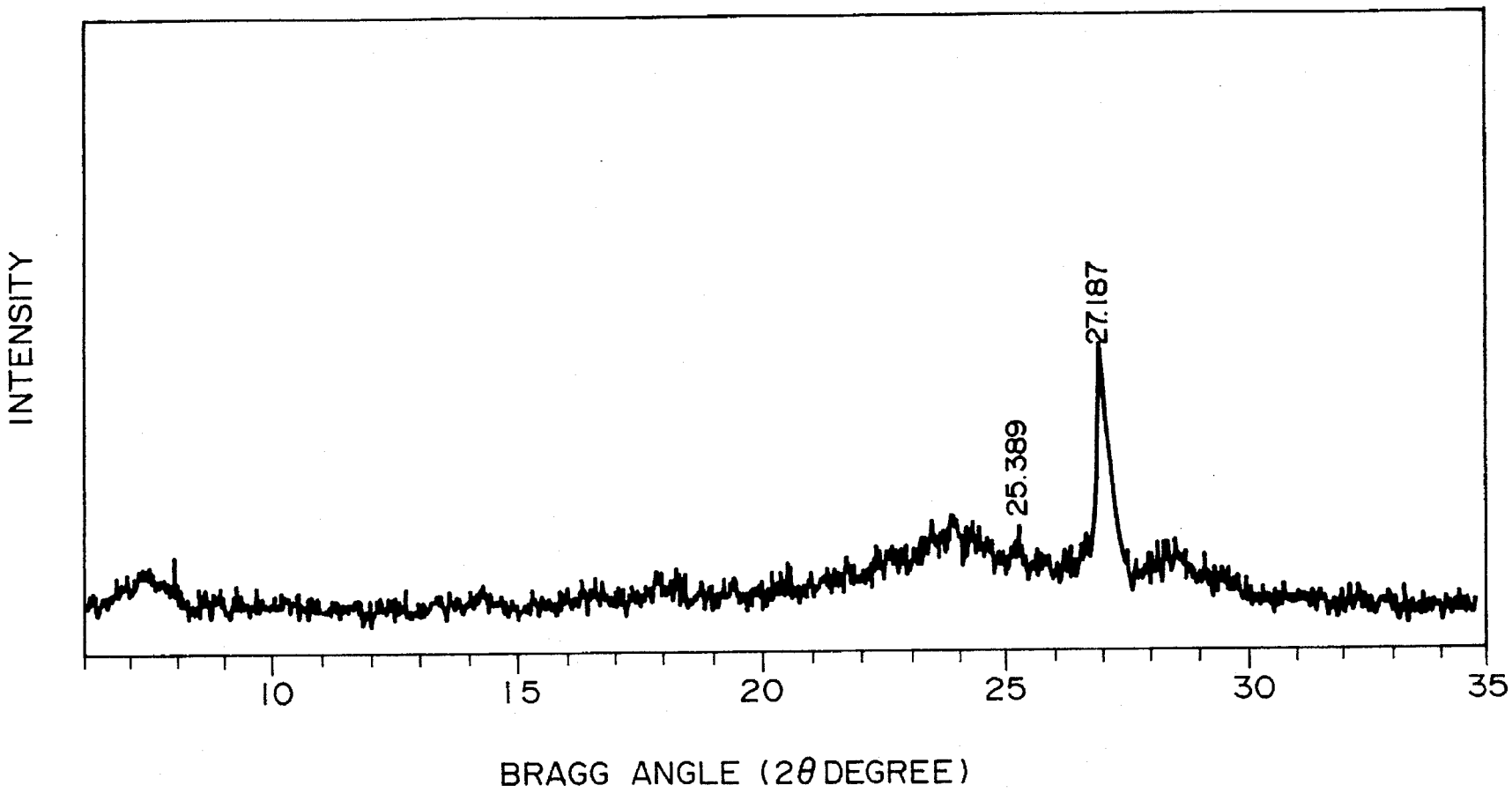
FIG. 2 is an X-ray diffraction pattern of the phthalocyanine prepared according to Preparation Example 2.

9 g of ion exchange water and 86 g of toluene were added to 1 g of the vacuum dried product obtained in the same manner as described above, and the solution was stirred under heating at 60° C. for 8 hours, filtered, washed with methanol and dried under heating at 60° C. for 4 hours to give the phthalocyanine crystals having main diffraction peaks at the Bragg angles (2°θ±0.2°) of 7.5°, 24.2° and 27.3°. A X-ray diffraction spectrum of the obtained crystals is shown in FIG. 2.

EXAMPLE 1

1.5 g of phthalocyanine produced in Preparation Example 1, 0.9 g of polyvinyl butyral resin ESLEX BL-S (produced by Sekisui Chemical Co., Ltd), 0.1 g of melamine resin ML351W (produced by Hitachi Chemical Co., Ltd.), 49 g of ethyl cellosolve and 49 g of tetrahydrofuran were dispersed in a ball mill and the dispersion was coated on an aluminum plate (electroconductive substrate, 100 mm×100 mm×0.1 mm) by dipping and dried at 120° C. for one hour to form a charge generation layer having a thickness of 0.5 μm.

A coating solution prepared by blending 1.5 g of the charge transport material No. 1 described above, 1.5 g of polycarbonate resin LEXAN 141 (produced by General Electric Co., Ltd.), 12.4 g of tetrahydrofuran and 3.1 g of anisole was dip coated on said substrate and dried at 120° C. under control so that the anisole content would become approximately 0.2% by weight to form a charge transport layer with a thickness of about 20 μm.

The electrophotographic properties (sensitivity, residual potential, dark decay and photoresponsiveness) of the obtained electrophotographic member were evaluated by Synthia 30HC (produced by GENTEC Co., Ltd.). The electrophotographic member was electrically charged to −650 V according to a corona discharge system and monochromatic light of 780 nm was applied to said member at 50 mS for determining the various properties. The definitions of the above properties are given below.

Sensitivity (E50) is represented by the amount of irradiation energy of 780 nm monochromatic light required for reducing by half the initial charging potential −650 V in a period of 0.2 seconds after exposure. Residual potential (Vr) is the potential which remains on the surface of the electrophotographic member 0.2 seconds after 50-millisecond exposure to monochromatic light of 20 mJ/m$^2$ of the same wavelength. Dark decay rate (DDR) was defined as ($V_1$/650)×100 from the initial charging potential −650 V of the electrophotographic member and the surface potential $V_1$ (−V)of the member after left at dark place for one second after initial charging. Photoresponsiveness ($T_{1/2}$) was defined as the time (sec) required for reducing by half the initial charging potential −650 V after 50 millisecond exposure to monochromatic light of 20 mJ/m$^2$ with a wavelength of 780 nm. The repetition characteristics were evaluated by the ratio of the charging potential $V_{1000}$ after 1,000 times of repetition of charging-exposure to the initial charging potential −650 V ($V_0$ retention) and retention of dark decay (DDR retention) rated in the similar way. The image quality was evaluated by fogging, black points, white stains and image density at black area by using an image quality evaluating device (negative-charged, reverse development system). The surface potential and the bias potential were set at −700 V and −600 V, respectively. The image density at the black area was measured by a Macbeth illuminometer (produced by A Division of Kollmergen Corporation). The results are shown in Table 1.

EXAMPLE 2

The procedure of Example 1 was carried out except for use of phthalocyanine obtained in Preparation Example 2 and charge transport material No. 2, and that drying was carried out at 100° C. such that the anisole content would become about 3.0% by weight to produce an electrophotographic member. The electrophotographic properties of the produced member were evaluated in the same way as Example 1. The results are shown in Table 1.

EXAMPLE 3

The procedure of Example 1 was followed except for use of τ type non-metallic phthalocyanine (produced by Toyo Ink Mfd. Co., Ltd.), charge transport material No. 3 and a tetrahydrofuran/anisole (1/1 by weight) mixed solvent for the coating solution for forming the charge transport layer, and that drying was carried out at 80° C. such that the anisole content would become about 8.0% by weight to produce an electrophotographic member and its properties were evaluated in the same way as Example 1. The results are shown in Table 1.

Comparative Example 1

The procedure of Example 1 was followed except that drying was carried out at 140° C. to provide an anisole content of about 0.01% by weight. The results of property evaluations of the obtained electrophotographic member are shown in Table 1.

Comparative Example 2

The procedure of Example 2 was followed except that drying was carried out at 50° C. to provide an anisole content of about 12.0% by weight. The results of property evaluations of the obtained electrophotographic member are shown in Table 1.

Comparative Example 3

The procedure of Example 3 was followed except that the solvent used for the coating solution for forming the charge transport layer was entirely replaced with tetrahydrofuran (THF). The results of property evaluations of the obtained electrophotographic member are shown in Table 1.

As shown in Table 1, while fogging was heavy in Comparative Examples 1–3, no fogging was shown in Examples 1–3. Therefore, the electrophotographic member using the composition for the photoconductive layer according to the present invention can provide excellent image quality.

TABLE 1

| | | | | | | Repetition Characteristics | | Image quality | | | |
|---|---|---|---|---|---|---|---|---|---|---|---|
| | Charge transport material | $E_{50}$ (mJ/m$^2$) | Vr (−V) | DDR (%) | $T_{1/2}$ (m/S) | $V_0$ retention (%) | DDR retention (%) | Fogging | Black points | White stains | Image density |
| Example 1 | No. 1 | 2.6 | 33 | 93.8 | 13 | 91.5 | 93.4 | None | None | None | 1.3 |

TABLE 1-continued

| | Charge transport material | $E_{50}$ (mJ/m$^2$) | Vr (−V) | DDR (%) | $T_{1/2}$ (m/S) | Repetition Characteristics $V_0$ retention (%) | Repetition Characteristics DDR retention (%) | Image quality Fogging | Image quality Black points | Image quality White stains | Image quality Image density |
|---|---|---|---|---|---|---|---|---|---|---|---|
| Example 2 | No. 2 | 2.5 | 30 | 95.8 | 12 | 90.5 | 95.3 | None | None | None | 1.4 |
| Example 3 | No. 3 | 2.8 | 36 | 94.0 | 13 | 91.0 | 93.9 | None | None | None | 1.4 |
| Comp. Example 1 | No. 1 | 4.2 | 48 | 77.0 | 16 | 72.5 | 87.5 | Heavy | Plenty | Plenty | 1.0 |
| Comp. Example 2 | No. 2 | 3.8 | 120 | 87.5 | 64 | 62.5 | 75.0 | Heavy | Plenty | Plenty | 0.8 |
| Comp. Example 3 | No. 3 | 3.7 | 45 | 76.9 | 19 | 73.3 | 86.6 | Heavy | Plenty | Plenty | 1.0 |

As described above, the electrophotographic member using the composition for the photoconductive layer according to the present invention is stabilized in its performance of maintaining charging potential and dark decay characteristics after repeated use, is capable of forming high-quality images and can be used stably for a long period of time without impairing its electrophotographic properties.

The present invention is further illustrated with reference to Examples 4–17 and Comparative Example which follow. The materials used in these examples are explained below. Given in the parentheses are the abbreviations of the materials.

(1) Charge generating material: τ type nonmetallic phthalocyanine (τ-$H_2$Pc) [produced by Toyo Ink Mfd. Co., Ltd.].

(2) Charge transport material: 1,1-bis(p-diethylaminophenyl)-4,4-diphenyl-1,3-butadiene (PBD).

(3) Binder:

(A) Binder for undercoating:

Polyamide resin MX1970 (MX1970), solid content: 100 wt % [produced by NIPPON RILSAN KK]. Melamine resin Melan 2000 (ML2000) (butylated melamine resin with bound formaldehyde number of 4.0 and methylol group number of 1.0), solid content: 50 wt % [produced by Hitachi Chemical Co. Ltd.].

(B) Binder for charge generation layer:

Polyester resin Vylon 290 (V290), solid content: 100 wt % [produced by Toyobo Co., Ltd.]. Melamine resin Melan 2000 (ML2000) (butylated melamine resin with bound formaldehyde number of 4.0 and methylol group number of 1.0), solid content: 50 wt % [produced by Hitachi Chemical Co., Ltd.]. Melamine resin Melan 351w (ML351w), solid content: 60 wt % [produced by Hitachi Chemical Co., Ltd.].

(C) Binder for charge transport layer:

Polycarbonate resin having the following repeating structural units TS-2050 (TS-2050), solid content: 100 wt % [produced by Teijin Chemical Co., Ltd.]:

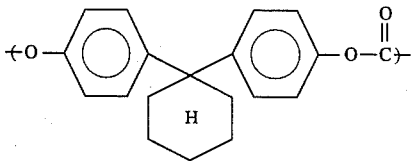

EXAMPLE 4

A coating solution was prepared by completely dissolving 35 g of MX1970, 70 g of ML2000 and 2.1 g of trimellitic acid in 1,800 g of a methanol/1-propanol (1/1 by weight) mixed solvent. This coating solution was dip coated on an aluminum drum (100 mm in outer diameter, 336 mm long and 2.6 mm thick) and dried at 0° C. for 60 minutes to form a 0.3 μm thick undercoat layer.

Then 50 g of τ-$H_2$Pc, 50 g of V290, 10 g of ML351w and 1,850 g of tetrahydrofuran (THF) were dispersed for 10 hours by using a supersonic dispersing machine, and the obtained composition for the charge generation layer was dip coated on said undercoat layer and dried at 140° C. for 60 minutes to form a 0.3 μm thick charge generation layer.

Then 60 g of PBD and 140 g of TS-2050 were completely dissolved in 800 g of a THF/anisole (2/3 by weight) mixed solvent, and this solution (composition for the charge transport layer) was dip coated on said charge generation layer having said undercoat layer to form a 20 μm thick charge transport layer.

EXAMPLE 5

In accordance with Example 4, a 0.3 μm thick undercoat layer was formed on an aluminum drum (100 mm in outer diameter, 336 mm long and 2.6 mm thick).

Then, in accordance with Example 4, a 0.3 μm thick charge generation layer was formed on said undercoat layer.

Then a coating solution was prepared by completely dissolving 60 g of PBD and 140 g of TS-2050 in 800 g of a THF/anisole (19/1 by weight) mixed solvent, and this coating solution (composition for the charge transport layer) was dip coated on said charge generation layer to form a 20 μm thick charge transport layer.

EXAMPLE 6

In accordance with Example 4, a 0.3 μm thick undercoat layer was formed on an aluminum drum (100 mm in outer diameter, 336 mm long and 2.6 mm thick).

Then, in accordance with Example 4, a 0.3 μm thick charge generation layer was formed on said undercoat layer.

Then a coating solution was prepared by completely dissolving 60 g of PBD and 140 g of TS-2050 in 800 g of a THF/anisole (4/1 by weight) mixed solvent, and this coating solution (composition for the charge transport layer) was dip coated on said charge generation layer having said undercoat and dried at 20° C. under control so that the anisole content would become about 0.2% by weight to form a 20 μm thick charge transport layer, thereby producing an electrophotographic member.

EXAMPLE 7

In accordance with Example 4, a 0.3 μm thick undercoat layer was formed on an aluminum drum (100 mm in outer diameter, 336 mm long and 2.6 mm thick).

Then, in accordance with Example 4, a 0.3 μm thick charge generation layer was formed on said undercoat layer.

Then a coating solution was prepared by completely dissolving 60 g of PBD and 140 g of TS-2050 in 800 g of a THF/anisole (2/3 by weight) mixed solvent, and this solution (composition for the charge transport layer) was dip coated on said charge generation layer having said undercoat layer and dried at 80° C. under control so that the anisole content would become about 8.0 wt % to form a 20 μm thick charge transport layer, thereby producing an electrophotographic member.

EXAMPLE 8

In accordance with Example 4, a 0.3 μm thick undercoat layer was formed on an aluminum drum (100 mm in outer diameter, 336 mm long and 2.6 mm thick).

Then, in accordance with Example 4, a 0.3 μm thick charge generation layer was formed on said undercoat layer.

Then a coating solution was prepared by completely dissolving 60 g of PBD and 140 g of TS-2050 in 800 g of a THF/anisole (3/7 by weight) mixed solvent, and this solution (composition for the charge transport layer) was dip coated on said charge generation layer having said undercoat layer to form a 20 μm thick charge transport layer.

Comparative Example 4

In accordance with Example 4, a 0.3 μm thick undercoat layer was formed on an aluminum drum (100 mm in outer diameter, 336 mm long and 2.6 mm thick).

Then, in accordance with Example 4, a 0.3 μm thick charge generation layer was formed on said undercoat layer.

Then a coating solution was prepared by completely dissolving 60 g of PBD and 140 g of TS-2050 in 800 g of a THF, and this solution (composition for charge transport layer for comparison) was dip coated on said charge generation layer having said undercoat layer to form a 20 μm thick charge transport layer.

EXAMPLE 9

The procedure of Example 6 was followed except that drying was carried out at 160° C. under control such that the anisole content would become about 0.01% by weight to produce an electrophotographic member.

EXAMPLE 10

The procedure of Example 7 was followed except that drying was carried out at 50° C. such that the anisole content would become about 12.0% by weight to produce an electrophotographic member.

The charge transport layers of the electrophotographic members obtained in Examples 4–10 and Comparative Example 4 were subjected to the evaluations of appearance, electrophotographic properties and image properties. (Appearance alone was evaluated with the products of Examples 4, 5 and 8 and Comparative Example 4.) The layer appearance was observed visually. The results are shown in Tables 2 and 3.

For the evaluation of electrophotographic properties, dark decay (DDR5) at the start and after printing of 200,000 copies, measured by a light decay measuring device (Synthia 30HC mfd. by GENTEC Co., Ltd.) with $V_0$ set at −700 V, residual potential (VL) 0.3 seconds after exposure and sensitivity ($E_{50}$) were evaluated.

Regarding DDR5, the potential ($V_5$) after 5 seconds in a dark place was measured, and the dark decay ratio was represented by $(V_5/V_0)\times100$ (%). $E_{50}$ is the value of energy required for reducing $V_0$ to −350 V when the layer was irradiated with light of 780 nm. $V_L$ designates surface potential when energy of 20 mJ/m$^2$ (wavelength: 780 nm) was applied.

As for image properties, the initial image conditions (fogging and density at the solid black portion) were evaluated by using an image evaluating device (negative-charged, reverse development system).

TABLE 2

| Electrophotographic member | Appearance of coat |
|---|---|
| Example 4 | Good |
| Example 5 | Good |
| Example 8 | Slight run of coating material |
| Comp. Example 4 | Clouded |

TABLE 3

| Electro-photographic member | Appearance of coat | Electrophotographic properties | | | Image qualities | |
|---|---|---|---|---|---|---|
| | | DDR5 (%) | $V_L$ (−V) | $E_{50}$ (mJ/m$^2$) | Fogging | Image density |
| Example 6 | Good | 93 | 63 | 3.0 | None | 1.4 |
| Example 7 | Good | 92 | 65 | 3.0 | None | 1.3 |
| Example 9 | Slightly nonuniform | 91 | 77 | 3.5 | Slight | 1.2 |
| Example 10 | Slightly nonuniform | 90 | 74 | 3.6 | Slight | 1.2 |

EXAMPLES 11–17

The electrophotographic members were produced by following the same procedure as Examples 4–1 except for use of ethoxybenzene in place of anisole, and they were evaluated in the same way as described above. The results are shown in Tables 4 and 5.

TABLE 4

| Electrophotographic member | Appearance of coat |
|---|---|
| Example 11 | Good |
| Example 12 | Good |
| Example 15 | Slight run of coating material |
| Comp. Example 4 | Clouded |

TABLE 5

| Electro-photographic member | Appearance of coat | Electrophotographic properties | | | Image qualities | |
|---|---|---|---|---|---|---|
| | | DDR5 (%) | $V_L$ (−V) | $E_{50}$ ($mJ/m^2$) | Fogging | Image density |
| Example 13 | Uniform | 93 | 70 | 3.4 | None | 1.3 |
| Example 14 | Uniform | 93 | 72 | 3.3 | None | 1.3 |
| Example 16 | Slightly nonuniform | 91 | 77 | 3.5 | Slight | 1.2 |
| Example 17 | Slightly nonuniform | 90 | 74 | 3.6 | Slight | 1.2 |

As described above, the composition for charge transport layer according to the present invention is capable of eliminating defective appearance of the coating film and forming a uniform film without using a halogen type solvent. Therefore, by using the composition for charge transport layer according to this invention, it is possible to produce an electrophotographic member which well conforms to the environmental requirements and is capable of forming a high-quality image.

The electrophotographic member provided according to the present invention can be favorably applied to high-speed printers which are required to have high operational performance and to give high image quality.

What is claimed is:

1. An electrophotograhic member comprising an electroconductive substrate, formed thereon a charge generation layer, and formed thereon a charge transport layer, said charge transport layer containing alkoxybenzene in an amount of 0.05 to 10% by weight based on the weight of the charge transport layer.

2. An electrophotographic member according to claim 1, wherein the alkoxybenzene is anisole or ethoxybenzene.

3. An electrophotographic member according to claim 1, wherein the charge transport layer is formed by drying at a temperature of 70° to 160° C.

4. An electrophotographic member according to claim 1, wherein the charge transport layer is formed by using the composition comprising a mixed solvent including alkoxybenzene, and a charge transport material.

5. A composition for forming a charge transport layer in an electrophotograhic member, said composition comprising a mixed solvent comprising 60 to 5% by weight of alkoxybenzene and 40 to 95% by weight of a halogen-free solvent, and a charge transport material.

6. A composition according to claim 5, wherein the alkoxybenzene is anisole or ethoxybenzene.

7. A composition according to claim 5, wherein the halogen-free solvent is tetrahydrofuran.

8. A composition according to claim 5, wherein the charge transport material is N,N'-bis(3-methylphenyl)-N,N'-bis[4-(2,2,2-trifluoroethoxy)phenyl]-(1,1'-biphenyl)-4,4'-diamine or 1,1-bis(p-diethylaminophenyl)-4,4-diphenyl-1,3-butadiene.

* * * * *